US007196675B2

(12) United States Patent
Wolfenden et al.

(10) Patent No.: US 7,196,675 B2
(45) Date of Patent: Mar. 27, 2007

(54) HIGH RESOLUTION ORIENTATION ADJUSTING ARRANGEMENT FOR FEED ASSEMBLY

(75) Inventors: Neil Wolfenden, Bracknell (GB); Andrew Baird, Bramley (GB)

(73) Assignee: Andrew Corporation, Westchester, IL (US)

( * ) Notice: Subject to any disclaimer, the term of this patent is extended or adjusted under 35 U.S.C. 154(b) by 76 days.

(21) Appl. No.: 10/907,205

(22) Filed: Mar. 24, 2005

(65) Prior Publication Data

US 2006/0214868 A1 Sep. 28, 2006

(51) Int. Cl.
*H01Q 19/12* (2006.01)

(52) U.S. Cl. ..... 343/840; 343/880

(58) Field of Classification Search ..... 343/840, 343/781 P, 786, 765, 757, 772, 761, 762, 343/880

See application file for complete search history.

(56) References Cited

U.S. PATENT DOCUMENTS

| | | | | |
|---|---|---|---|---|
| 4,251,819 | A | 2/1981 | Vickland | |
| 4,404,565 | A | 9/1983 | Gurney et al. | |
| 4,652,890 | A | 3/1987 | Crean | |
| 4,692,771 | A | 9/1987 | Rothbarth et al. | |
| 4,819,006 | A | 4/1989 | Whitesides et al. | |
| 4,819,007 | A | 4/1989 | Tezcan | |
| 4,924,239 | A | 5/1990 | Ceklovsky | |
| 4,980,697 | A | 12/1990 | Eklund | |
| 4,994,816 | A | 2/1991 | Kondo | |
| 5,000,408 | A | 3/1991 | Bourgeois et al. | |
| 5,402,140 | A | 3/1995 | Rodeffer | |
| 5,657,031 | A | 8/1997 | Anderson et al. | |
| 5,870,060 | A * | 2/1999 | Chen et al. | 343/761 |
| 5,929,817 | A | 7/1999 | Clark | |
| 5,933,123 | A | 8/1999 | Kaul | |
| 5,982,333 | A | 11/1999 | Stillinger et al. | |
| 5,999,139 | A | 12/1999 | Benjamin et al. | |
| 6,208,317 | B1 | 3/2001 | Taylor et al. | |
| 6,225,962 | B1 | 5/2001 | Blanchard et al. | |
| 6,342,870 | B1 | 1/2002 | Mehrkens et al. | |
| 6,404,400 | B1 | 6/2002 | Tulloch | |
| 6,445,361 | B2 | 9/2002 | Liu et al. | |
| 6,462,718 | B1 | 10/2002 | Ehrenberg et al. | |
| 6,507,325 | B2 | 1/2003 | Matz et al. | |
| 6,512,485 | B2 * | 1/2003 | Luly et al. | 343/781 CA |
| 6,657,598 | B2 | 12/2003 | Tulloch | |
| 2002/0018016 | A1 | 2/2002 | Radonic | |
| 2003/0107525 | A1 * | 6/2003 | Ehrenberg et al. | 343/881 |

(Continued)

FOREIGN PATENT DOCUMENTS

| | | |
|---|---|---|
| EP | 0253425 | 1/1988 |

(Continued)

*Primary Examiner*—Hoanganh Le
(74) *Attorney, Agent, or Firm*—Babcock IP, PLLC

(57) ABSTRACT

A receptacle with an adjusting slot is adapted to receive a mounting lip of the feed assembly. A means for positioning which may include a threaded shaft threaded into a first side of the receptacle that projects into a first side of the mounting lip, is operative to move the mounting lip within the adjusting slot. A bias spring may be positioned between the mounting lip and a second side of the mounting lip, the bias spring biasing the mounting lip against the threaded shaft. Alternatively, the threaded shaft may extend threaded through the mounting lip, longitudinally retained with respect to the receptacle operative to move the mounting lip along the adjusting slot as the threaded shaft is rotated.

19 Claims, 6 Drawing Sheets

U.S. PATENT DOCUMENTS

| | | | |
|---|---|---|---|
| 2004/0169114 | A1 | 9/2004 | Dierkes |
| 2004/0222931 | A1 | 11/2004 | Matz et al. |

FOREIGN PATENT DOCUMENTS

| | | |
|---|---|---|
| EP | 1017125 | 7/2000 |
| WO | 9960658 | 11/1999 |
| WO | 0235649 | 5/2002 |
| WO | 1227541 | 7/2002 |

* cited by examiner

HIGH RESOLUTION ORIENTATION ADJUSTING ARRANGEMENT FOR FEED ASSEMBLY

BACKGROUND

For optimal performance, a directional antenna such as a reflector antenna must be closely aligned with a target signal source. Alignment of a reflector antenna is typically performed via an adjustable antenna mount that, with respect to a fixed mounting point, is adjustable in azimuth and elevation to orient the antenna towards the target.

Because the entire antenna assembly is adjusted, the adjustable antenna mount must be designed to support the entire antenna mass and also withstand any expected environmental factors such as wind shear and or ice loading. Adjustable antenna mounts that are both strong and easily adjustable with precision significantly increase the cost of the resulting antenna.

High resolution azimuth adjustment capability is increasingly important for multiple feed reflector antennas used with satellites positioned in equatorial orbit. Where multiple feeds are applied to a single reflector to simultaneously receive closely spaced beams from different satellites, alignment is critical to achieve acceptable signal performance with respect to each of the satellites. Although equatorial orbits are generally constant by definition, in reality there is a certain range of azimuth "wobble" to an equatorial orbit that determines the precise position of the satellite at any given instant. When multiple satellites are targeted using multiple feeds of a common reflector the "wobble" position of each satellite may at one extreme or the other unacceptably degrade performance of the other signals as they move through their own ranges of positional "wobble". High resolution adjustment capability may also be used for a single feed reflector and or terrestrial applications where precision accuracy is required.

To avoid configuring a reflector antenna for a primary satellite alignment other than the middle of a known wobble range an installation technician first aligns the antenna for maximum signal strength with respect to the primary satellite. Then, by contacting a satellite ground control resource the installation technician can obtain a desired azimuth offset representing the present distance of the primary satellite from the center of its wobble range. These adjustments are extremely small, creating a need for azimuth adjustments that are easy to perform, accurately controlled, easily measurable and reliably repeatable for a given input.

The increasing competition for reflector antennas adapted for high volume consumer applications such as satellite tv and or internet communications has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
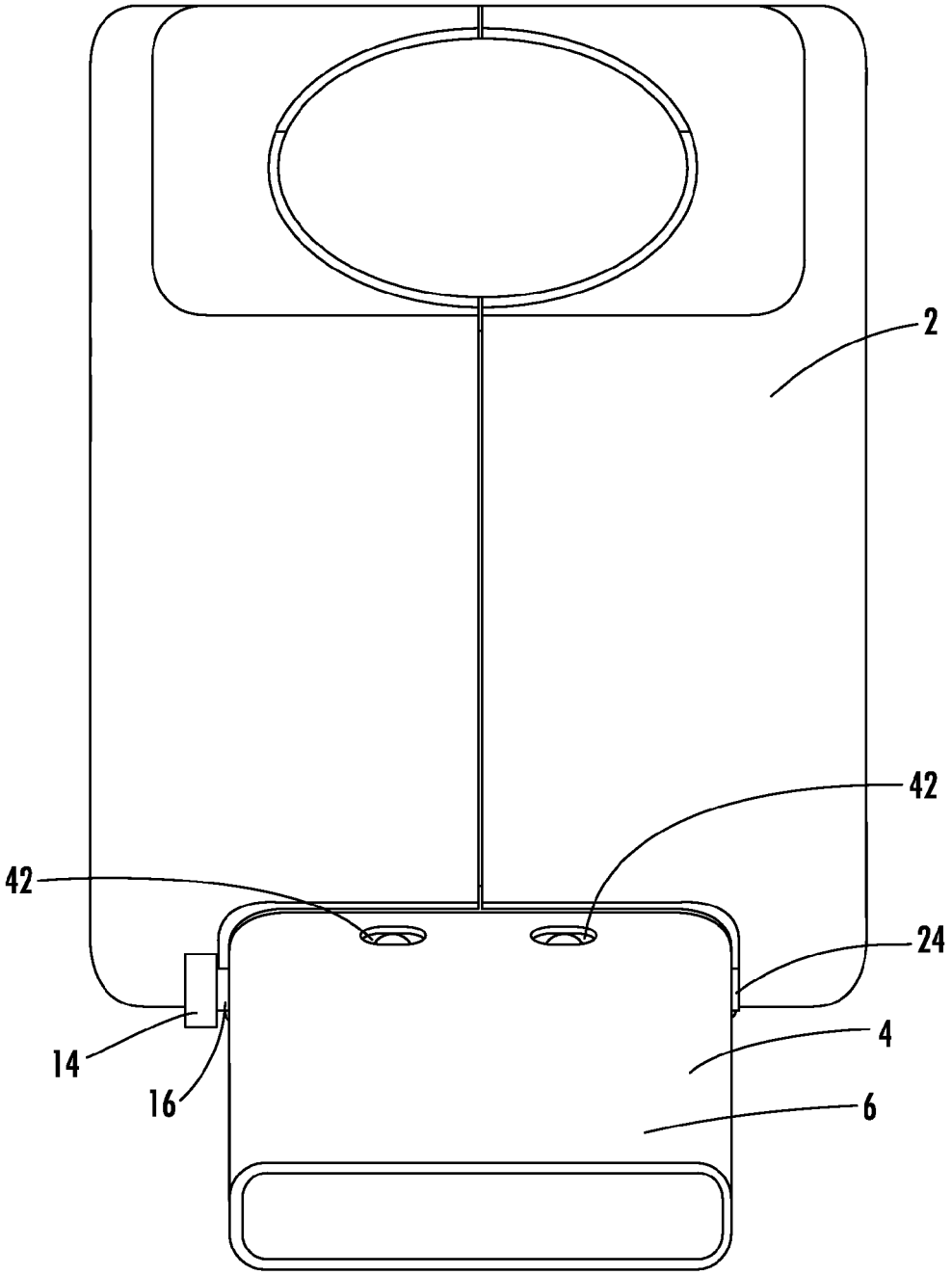
FIG. 1 is a schematic front view of a first exemplary embodiment of the invention, shown applied to a feed assembly.

Applicant has recognized that rather than adjusting the entire antenna structure, accurate azimuth fine tuning functionality may be cost effectively implemented by adjusting the feed assembly with respect to the feed assembly connection with the boom arm and or the reflector of the antenna. A small adjustment to the orientation of the feed assembly with respect to the reflector adjusts the, for example, azimuth beam alignment but does not significantly affect alignment of the feed assembly with a focal area of the reflector.

A first exemplary embodiment of the invention is shown in FIGS. 1–4. A feed assembly 2 is coupled to a receptacle 4 such as an adjusting collar 6 that is in turn mounted to a boom arm of the reflector antenna (not shown). Existing feed assembly 2 configurations may have a mounting lip 8 adapted to fit into the open end of a hollow boom arm. These configurations may be readily adapted according to the invention with a minimum of additional adaptations. The mounting lip 8 is inserted into an adjusting slot 10 of the receptacle 4, here demonstrated as an adjusting collar 6. Alternatively, the receptacle 4 function may be incorporated into an end of the boom arm and or directly to the main reflector.

Figure 2:
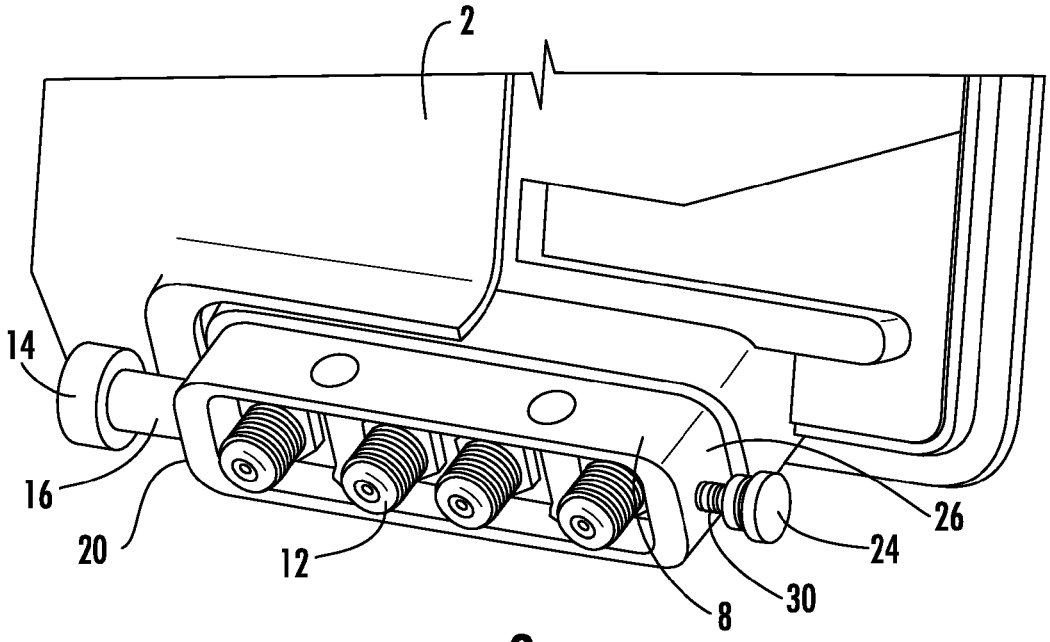
FIG. 2 is a schematic isometric close-up view of FIG. 1, with the receptacle and a portion of the feed assembly cover omitted for clarity.
Figure 3:
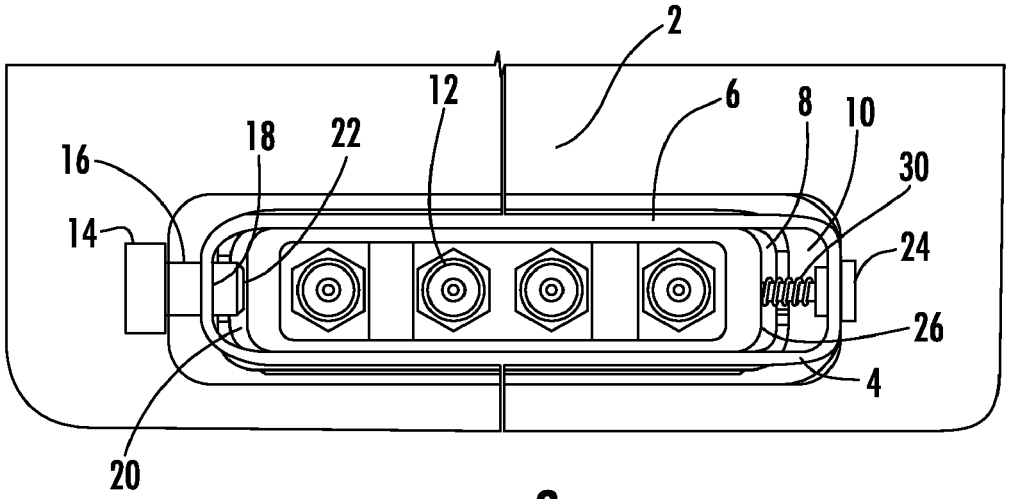
FIG. 3 is a schematic close-up view of FIG. 1, normal to a cross section of the receptacle, demonstrating a left range of adjustment.
Figure 4:
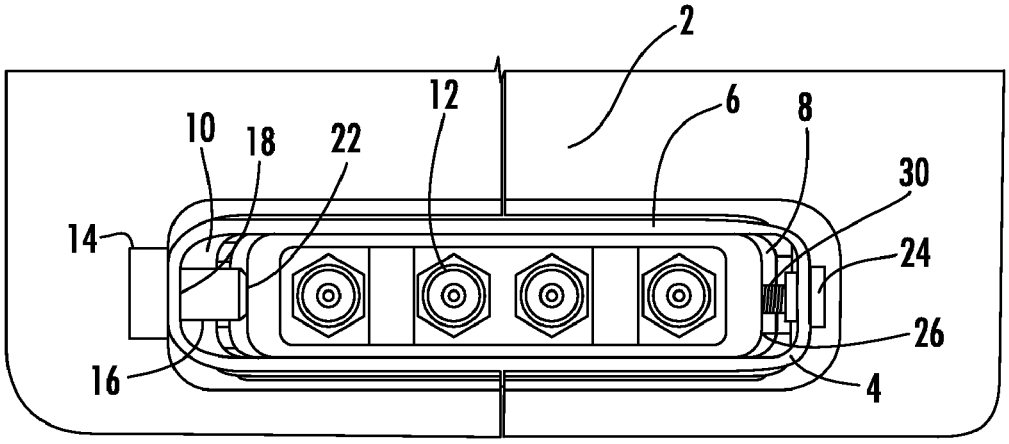
FIG. 4 is a schematic close-up view of FIG. 1, normal to a cross section of the receptacle, demonstrating a right range of adjustment.

The adjusting slot 10 is dimensioned with respect to the mounting lip 8 for a close vertical fit and free horizontal movement over a desired range as demonstrated by FIGS. 2 and 3. If output(s) 12 of the feed assembly 2 are being routed through a hollow boom arm, the adjusting slot 10 may be formed passing end to end through the receptacle 4, providing an internal cable path.

An adjusting knob 14 with a threaded shaft 16 threads into a corresponding threaded hole 18 formed in a first side 20 of the receptacle 4. The threaded shaft 16 extends into the adjusting slot 10 into contact with a first side 20 of the mounting lip 8, setting the horizontal position of the mounting lip 8 and thereby the feed assembly 2 within the adjusting slot 10. To minimize the opportunity for the threaded shaft 16 to skew as it rotates against the mounting lip 8, a seating hole 22 may be formed in the mounting lip 8 to receive the distal end of the threaded shaft 16. A guide pin 24 positioned in a second side 26 of the adjusting slot 10 also fits into a corresponding seating hole 28 on the second side 26 of the mounting lip. A bias spring 30 on the guide pin 24 is compressed between the receptacle 4 and the mounting lip 8, biasing the receptacle 4 against the threaded shaft 16.

As the adjusting knob 14 is turned to thread the threaded shaft 16 into the threaded hole 18 of the receptacle 4, the mounting lip 8 is moved against the bias spring 30. Conversely, as the adjusting knob 14 is turned to thread the threaded shaft 16 out of the receptacle 4, the bias spring 30 holds the mounting lip 8 against the retracting distal end of the threaded shaft 16. Thereby, the mounting lip 8 may be positioned horizontally within the receptacle 4 according to the position of the threaded shaft 16. A further benefit of the bias spring 30 is that the constant bias against the threaded shaft 16 reduces the potential for any threading slop or backlash that may be present between the threading of the threaded shaft 16 and the threaded hole 18.

Angular resolution of azimuth corrections introduced by horizontal feed assembly 2 movements resulting from rotation of the adjusting knob 14 is a function of the selected thread pitch applied to the threaded shaft 16 and corresponding threaded hole 18. For example, in a typical consumer digital satellite TV reflector antenna embodiment, a thread pitch resulting in a threaded shaft 16 displacement of 2.5 mm every 4 turns equates to an angular resolution of approximately 0.025 degrees for every quarter turn of the adjusting knob 14.

Figure 5:
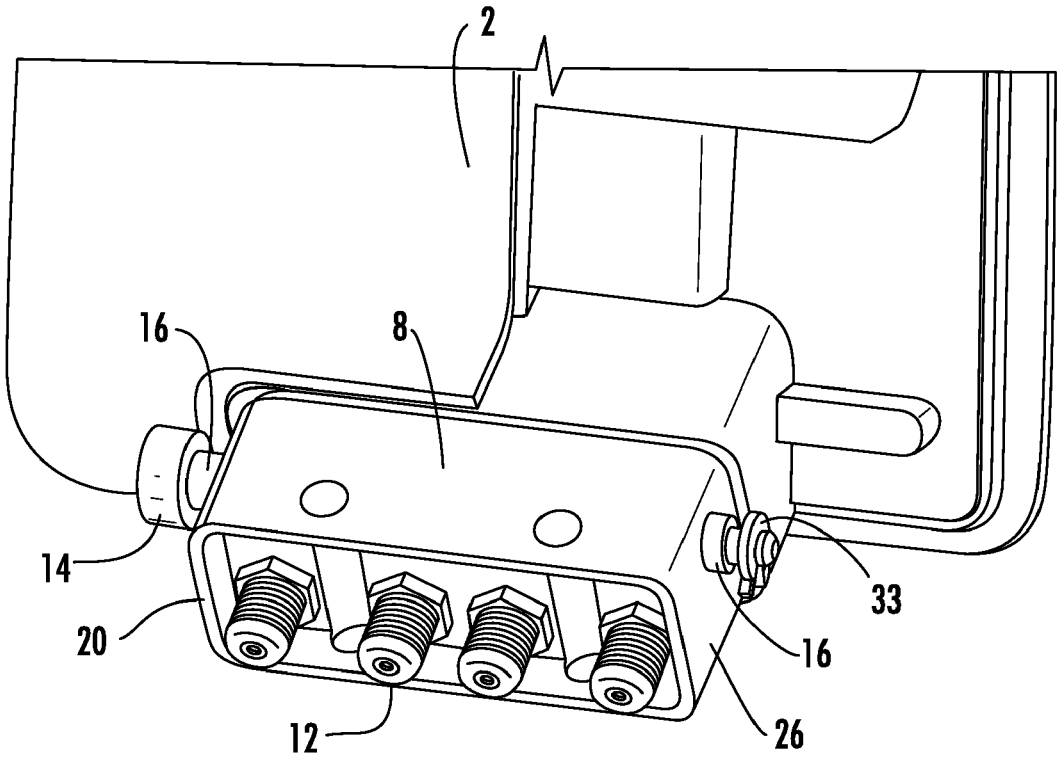
FIG. 5 is a schematic isometric close-up view of a second exemplary embodiment of the invention, with the receptacle and a portion of the feed assembly cover omitted for clarity.
Figure 6:
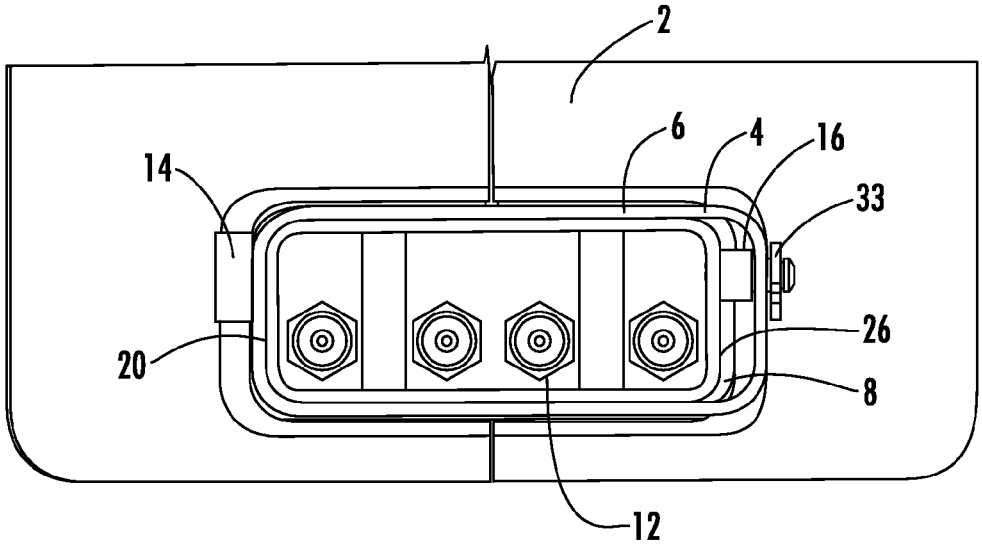
FIG. 6 is a schematic close-up view of the alternative embodiment, normal to a cross section of the receptacle, demonstrating a left range of adjustment.
Figure 7:
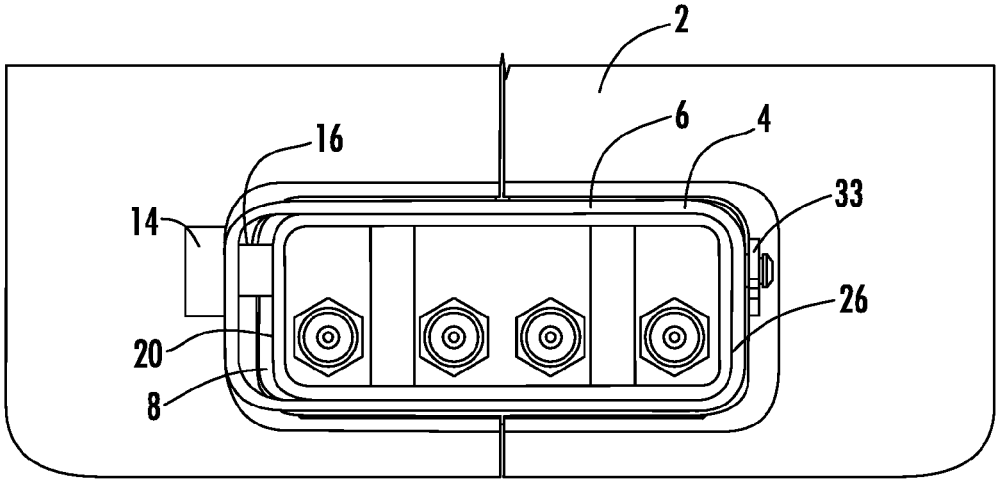
FIG. 7 is a schematic close-up view of the alternative embodiment, normal to a cross section of the receptacle, demonstrating a right range of adjustment.

In alternative embodiments the means for positioning the mounting lip within the adjusting slot may be adapted according to a range of different threaded shaft configurations, as shown for example by FIGS. 5–7 the length of the threaded shaft 16 may be extended to pass across the receptacle 4, through the mounting lip 8. The receptacle 4 then acts as a carrier for the threaded shaft 16 now threaded through the mounting lip 8 of the feed assembly 2. With either end of the threaded shaft 16 passing through unthreaded hole(s) at both sides of the receptacle 4 and held longitudinally captive between the adjusting knob 14 and a stop 33 such as a retaining clip or the like on the distal end of the threaded shaft 16, respectively, rotation of the threaded shaft 16 via the adjusting knob 14 operates to thread the mounting lip 8 and thereby the feed assembly 2 left or right within the adjusting slot 10, as shown in FIGS. 6 and 7. If desired, a bias spring 30 for example in the form of a coil spring as shown in FIGS. 2 and 3 or a spring washer, not shown, may be added at either inside or outside end of the receptacle 4 or adjusting slot 10 to reduce the potential for any threading slop or backlash that may be present between the threaded shaft 16 and the threads within the mounting lip 8.

Figure 8:
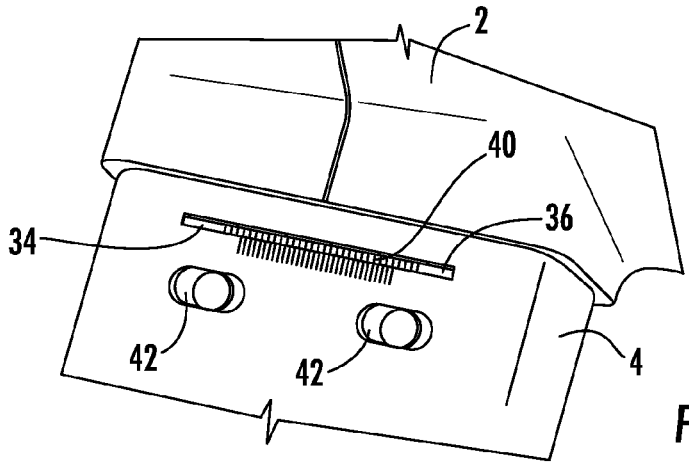
FIG. 8 is a schematic isometric view of a first adjustment scale embodiment, fine adjusting hardware omitted for clarity.
Figure 9:
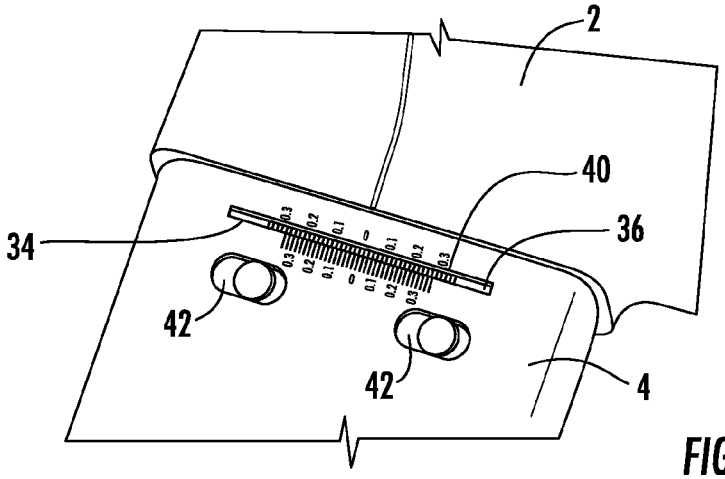
FIG. 9 is a schematic isometric view of a second adjustment scale embodiment fine adjusting hardware omitted for clarity.
Figure 10:
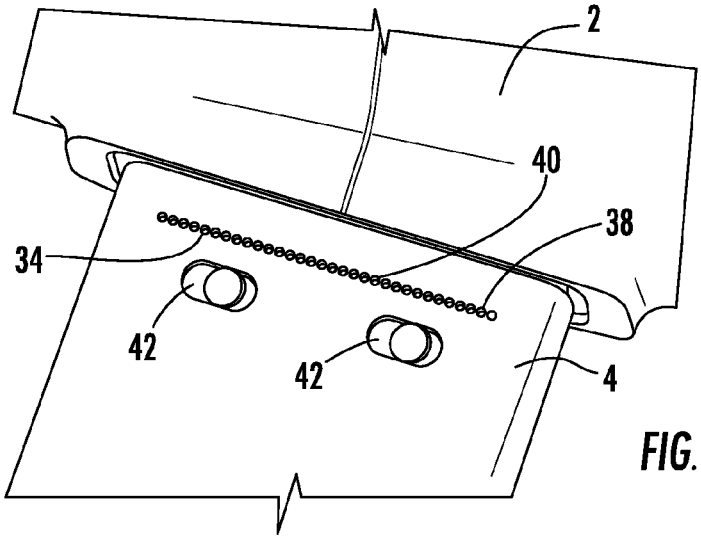
FIG. 10 is a schematic isometric view of a third adjustment scale embodiment fine adjusting hardware omitted for clarity.

As shown in FIGS. 8–10, vernier scale(s) 34 of various types may be applied to the receptacle 4 to provide a ready visual reference of azimuth adjustment progress as the adjustment knob 14 is turned. At least one aperture in the form of a slot 36 or series of scale hole(s) 38 in the receptacle 4 may be used to view scale marking(s) 40 printed upon, etched or cast into the mounting lip 8. Alternatively, the vernier scale(s) 34 may be applied along a top edge of the receptacle 4, proximate corresponding scale marking(s) 40 on the feed assembly 2 above the mounting lip 8, reducing the number of required receptacle 4 machining steps.

Although the adjusting knob 14 precisely positions the feed assembly 2 within the receptacle 4, further fastening may be applied to securely hold the feed assembly 2 in the final adjustment position. In the present embodiment(s), retaining fasteners (not shown) may be applied passing through horizontally elongated fastener slot(s) 42 formed in the top of the receptacle 4 either bolting across or threading into the mounting lip 8 of the feed assembly 2. When a final adjustment of the feed assembly 2 with respect to the receptacle 4 has been completed, the feed assembly 2 may be securely fixed in place by tightening the retaining fastener (s).

One skilled in the art will appreciate that the precision orientation adjustments enabled by the present invention significantly reduces the complexity and precision adjustability requirements of the general antenna mount required for a reflector antenna incorporating the invention, resulting in a significant reduction in overall cost. Also, the time required for installation and configuration of the reflector antenna is similarly reduced.

It should further be appreciated that, while the embodiments described herein demonstrate a feed assembly arrangement oriented to provide for feed assembly fine azimuth adjustment, the invention may also be applied within the scope of the attached claims with respect to elevation adjustment or a combination thereof via an adaptation of the adjusting slot orientation.

Table of Parts

| | |
|---|---|
| 2 | feed assembly |
| 4 | receptacle |
| 6 | adjusting collar |
| 8 | mounting lip |
| 10 | adjusting slot |
| 12 | output |
| 14 | adjusting knob |
| 16 | threaded shaft |
| 18 | threaded hole |
| 20 | first side |
| 22 | seating hole |
| 24 | guide pin |
| 26 | second side |
| 28 | seating hole |
| 30 | bias spring |
| 32 | threaded rod |
| 33 | stop |
| 34 | vernier scale |
| 36 | slot |
| 38 | scale hole |
| 40 | scale marking |
| 42 | fastener slot |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An adjustable orientation arrangement for a feed assembly, comprising:

a receptacle having an adjusting slot adapted to receive a mounting lip of the feed assembly;

a threaded shaft threaded into the receptacle, the threaded shaft projecting into the adjusting slot and abutting a first side of the mounting lip; and a bias spring positioned between a second side of the mounting lip and the adjusting slot, the bias spring biasing the mounting lip against the threaded shaft.

2. The arrangement of claim 1, further including an adjusting knob coupled to the threaded shaft.

3. The arrangement of claim 1, further including a guide pin mounted to the receptacle, the guide pin projecting into the second side of the mounting lip;

the bias spring mounted on the guide pin.

4. The arrangement of claim 3, wherein the guide pin passes through a guide hole in the second side of the mounting lip.

5. The arrangement of claim 1, further including at least one retaining fastener passing through an elongated slot in the receptacle and one of threading into and bolting across the mounting lip, retaining the mounting lip in position with respect to the receptacle.

6. The arrangement of claim 1, wherein the receptacle is formed with a greater thickness on the first side than on a top and a bottom.

7. The arrangement of claim 1, further including at least one aperture formed in one of the top and the bottom of the receptacle; and at least one scale mark(s) on the mounting lip visible through the aperture; the scale marks adapted to indicate relative position of the mounting lip within the adjusting slot.

8. The arrangement of claim 7, wherein the aperture is a slot coaxial with an axis between the first side and the second side.

9. The arrangement of claim 7, wherein the at least one aperture is a plurality of holes in a linear alignment.

10. The assembly of claim 1, wherein the receptacle is an adjusting collar coupled to a boom arm.

11. An adjustable orientation arrangement for a feed assembly, comprising:

a receptacle having an adjusting slot adapted to receive a mounting lip of the feed assembly;

a threaded shaft passing through the receptacle, threaded through the mounting lip;

at least one aperture formed in one of the top and the bottom of the receptacle; and at least one scale mark(s) on the mounting lip visible through the aperture; the scale marks adapted to indicate relative position of the mounting lip within the adjusting slot;

the threaded shaft longitudinally retained by the receptacle, rotation of the threaded shaft operative to move the mounting lip longitudinally within the adjusting slot.

12. The arrangement of claim 11, further including an adjusting knob coupled to the threaded shaft.

13. The arrangement of claim 11, further including a bias spring on the threaded shaft operative to bias the threaded shaft against the mounting lip.

14. The arrangement of claim 11, further including at least one retaining fastener passing through an elongated slot in the receptacle and one of threading into and bolting across the mounting lip, retaining the mounting lip in position with respect to the receptacle.

15. The arrangement of claim 11, wherein the aperture is a slot coaxial with an axis between the first side and the second side.

16. The arrangement of claim 11, wherein the receptacle is an adjusting collar coupled to a boom arm.

17. An adjustable orientation arrangement for a feed assembly, comprising:

a receptacle having an adjusting slot adapted to receive a mounting lip of the feed assembly;

a means for positioning the mounting lip within the adjusting slot and;

a bias spring on the means for positioning operative to bias the means for positioning against the mounting lip.

18. The arrangement of claim 17, wherein the means for positioning is a threaded shaft threaded through the receptacle to abut the mounting lip.

19. The arrangement of claim 17, wherein the means for positioning is a threaded shaft extending threaded through the mounting lip and longitudinally retained by the receptacle.

* * * * *